US008898949B1

(12) United States Patent
Greenwood

(10) Patent No.: US 8,898,949 B1
(45) Date of Patent: Dec. 2, 2014

(54) FIREARM TACTICAL RAIL MOUNTING BRACKET

(75) Inventor: Timothy L. Greenwood, Hays, KS (US)

(73) Assignee: Timothy L. Greenwood, Hays, KS (US)

( * ) Notice: Subject to any disclaimer, the term of this patent is extended or adjusted under 35 U.S.C. 154(b) by 215 days.

(21) Appl. No.: 13/531,509

(22) Filed: Jun. 23, 2012

Related U.S. Application Data

(60) Provisional application No. 61/515,188, filed on Aug. 4, 2011.

(51) Int. Cl.
*F41G 1/387* (2006.01)
*F41G 1/16* (2006.01)

(52) U.S. Cl.
CPC .. *F41G 1/387* (2013.01); *F41G 1/16* (2013.01)
USPC ..... 42/90; 42/124

(58) Field of Classification Search
CPC ..... F41G 1/00; F41G 1/16; F41G 1/38; F41G 1/387; F41G 11/00; F41G 11/001; F41G 11/003; F41G 11/004
USPC ..... 42/90, 111, 114, 119, 124–127, 146
See application file for complete search history.

(56) References Cited

U.S. PATENT DOCUMENTS

| | | | | |
|---|---|---|---|---|
| 6,449,893 | B2 * | 9/2002 | Spinner | 42/127 |
| 7,814,698 | B2 * | 10/2010 | Fluhr et al. | 42/127 |
| 2001/0022044 | A1 * | 9/2001 | Spinner | 42/124 |
| 2010/0005697 | A1 * | 1/2010 | Fluhr et al. | 42/111 |
| 2010/0229450 | A1 * | 9/2010 | Becker et al. | 42/90 |

* cited by examiner

*Primary Examiner* — Jonathan C Weber
(74) *Attorney, Agent, or Firm* — Kenneth H. Jack; Davis & Jack, L.L.C.

(57) ABSTRACT

A mounting bracket for attachment to a firearm's tactical rail, the mounting bracket including a "C" member having a web and lateral and oppositely lateral hooks, the web further having a seam dividing the "C" member into lateral and oppositely lateral halves; extending and retracting slide bars and slide channel combinations connected to the "C" member's halves for movements of the halves between first and second positions, the halves in their first positions displacing from each other for rail receipts and releases, and the halves, upon opposite movements, capturing the rail between the "C" member's lateral and oppositely lateral hooks; and latching pawls connected to the "C" member's lateral and oppositely lateral halves for, upon movements of the halves to the second positions, alternatively resisting and permitting movements of the halves to their first positions.

19 Claims, 13 Drawing Sheets

FIREARM TACTICAL RAIL MOUNTING BRACKET

CLAIM OF PRIORITY FROM PREVIOUSLY FILED PROVISIONAL PATENT APPLICATION

This non-provisional patent application claims the benefit of and priority from U.S. provisional patent application No. 61/515,188 filed Aug. 4, 2011. The applicant asserts that structures and functions of structures disclosed and described in the instant application are substantially the same as those disclosed in said provisional application. The inventor, Timothy L. Greenwood, who is disclosed in said provisional patent application as a co-inventor among two co-inventors, is one and the same person as the Timothy L. Greenwood who presents the instant patent application as sole applicant and sole inventor, he asserting herein that he in fact is sole inventor. Nicholas L. Jensen, who was listed in said provisional patent application as the other co-inventor, does not join in the instant patent application as a co-inventor or as a co-applicant. The difference between the co-inventorship disclosed in said provisional application and the sole inventorship asserted herein constitutes a correction of the disclosed inventorship. Notwithstanding, an assignment by Nicholas L. Jensen of any and all of his ownership of the subject invention to Timothy L. Greenwood is contemporaneously filed.

FIELD OF THE INVENTION

This invention relates to mounting brackets and couplers which are adapted for attachment to firearm tactical rails, which rails are also known as Picatinny rails, U.S. MIL-STD-1913 rails, or NATO Standard Agreement (STANAG) 2324 rails.

BACKGROUND OF THE INVENTION

Small firearms ends are commonly known to incorporate and present at their forestock areas and/or at their breach or rear breach ends tactical rail structures which are also known as Picatinny rails, U.S. MIL-STD-1913 rails, or NATO Standard Agreement (STANAG) 2324 rails. Such tactical rails are typically provided for mounting support of auxiliary firearm components such as gun slings, rifle scopes, rifle laser target illuminators, flashlights, spent shell collectors, and the like. Such mounts and couplers typically inadequately facilitate both quick attachment and quick disconnect functions.

The instant inventive mounting bracket for attachment to a firearm's tactical rail incorporates unique quick attachment and quick detachment structures which effectively and efficiently facilitate quick attach and quick disconnect couplings with tactical rails, and further facilitate secure mounts of auxiliary firearm components thereon.

BRIEF SUMMARY OF THE INVENTION

The instant inventive mounting bracket is specially adapted for attachment to a firearm's longitudinally extending tactical rail, such rails being commonly alternatively referred to as Picatinny rails, U.S. MIL-STD-1913 rails, or NATO Standard Agreement (STANAG) 2324 rails. Such tactical rails commonly present an alternating series of "T" segments and voids, each "T" segment having laterally and oppositely laterally extending (or left and right extending) arms, and such tactical rails commonly further have an inwardly extending (i.e., from the "T" segment toward a firearm upon which the tactical rail is attached) base member which forms the column portion of the rail's "T" configuration.

In a preferred embodiment, the instant inventive mounting bracket comprises a "C" member having a laterally extending web portion, the web having outer and inner faces, having lateral and oppositely lateral ends, and have longitudinal and oppositely longitudinal ends. In a preferred embodiment, the "C" member further has and presents lateral and oppositely lateral hooks, each hook having a distal end. In a preferred embodiment, the "C" member's lateral and oppositely lateral hooks are respectively fixedly attached to and inwardly cantilever from the web's lateral and oppositely lateral ends. Also in the preferred embodiment, the distal end of each hook among the lateral and oppositely lateral hooks extends toward the other hook among said hooks. Also in the preferred embodiment, the "C" member's web is longitudinally seamed, such seam advantageously sectioning the "C" member into lateral and oppositely lateral halves which work together for facilitating the mounting bracket's attaching and detaching functions which are further discussed below.

The instant inventive mounting bracket preferably further comprises extending and retracting means which are connected operatively to the "C" member's lateral and oppositely lateral halves, the extending and retracting means preferably being adapted for facilitating movements of said halves between first and second positions. The lateral and oppositely lateral "C" member halves, upon movements to their first positions preferable displace laterally away from each other for facilitating receipts and releases of tactical rail "T" segments. Alternatively, and following a receipt of tactical rail "T" segments within the instant inventive mounting bracket, said halves may move laterally toward each other and toward their retracted second positions to capture and securely hold the received "T" segments between the "C" member's lateral and oppositely lateral hooks.

In a preferred embodiment, the extending and retracting means comprise at least a first and preferably a plurality of slide bar and slide channel combinations, such combinations' slide channels preferably extending laterally through both of the "C" member's halves for lateral extending and retracting or opening and closing movements of such halves along the laterally nestingly received slide bars. Other commonly known extending and retracting means such as slide ridge and slide channel combinations may suitably serve as the instant invention's extending and retracting means, such alternative extending and retracting means structures being considered to fall within the scope of the invention.

A further structural component of the instant inventive mounting bracket preferably comprises latching means which are connected operatively to the "C" member's lateral and oppositely lateral halves, the latching means preferably being adapted for, upon closing movements of said halves to their second positions, alternatively resisting and permitting movements of said halves toward their opened first positions. In a preferred embodiment, the latching means component of the instant invention comprise a pair of movable pawls having pivoting base ends mounted to one of the "C" member's halves, and having hook ends adapted for engaging the other of the "C" member's halves. Other commonly known releasable latch mechanisms may be suitably alternatively utilized and are considered to fall within the scope of the instant invention.

The instant inventive mounting bracket preferably comprises at a least a first, and preferably a pair of tactical rail "T" segment void engaging slide stops. Where the extending and retracting means comprise, as is preferred, a pair of laterally extending slide bars, the laterally extending channels which nestingly receive such bars preferably open inwardly at the inner face of the "C" member's web, such inward openings allowing for inward protrusions of the cylindrical bodies of the slide bars within the inwardly opening rail grasping space defined by the "C" member. Such orientation and configuration of components advantageously allows the extending and retracting means' slide bars to further function as slide stops which resist longitudinal movement of the instant inventive bracket with respect to a tactical rail upon which the mounting bracket is attached. According to such preferred slide stop configuration, portions of the cylindrical walls of the slide bars, upon mounting of the mounting bracket upon a tactical rail, advantageously extend into the voids or hollows existing between such rails "T" segments, such extensions interfering with and locking against longitudinal mounting bracket movement.

Accordingly, objects of the instant invention include the provision of a mounting bracket for attachment to a firearm's longitudinally extending tactical rail wherein the bracket incorporates structures as described above, and wherein such structures are arranged with respect to each other, as described above, for performance of beneficial functions, as described above.

Other and further objects, benefits, and advantages of the invention will become known to those skilled in the art upon review of the Detailed Description which follows, and upon review of the appended drawings.

DETAILED DESCRIPTION OF A PREFERRED EMBODIMENT

Figure 1:
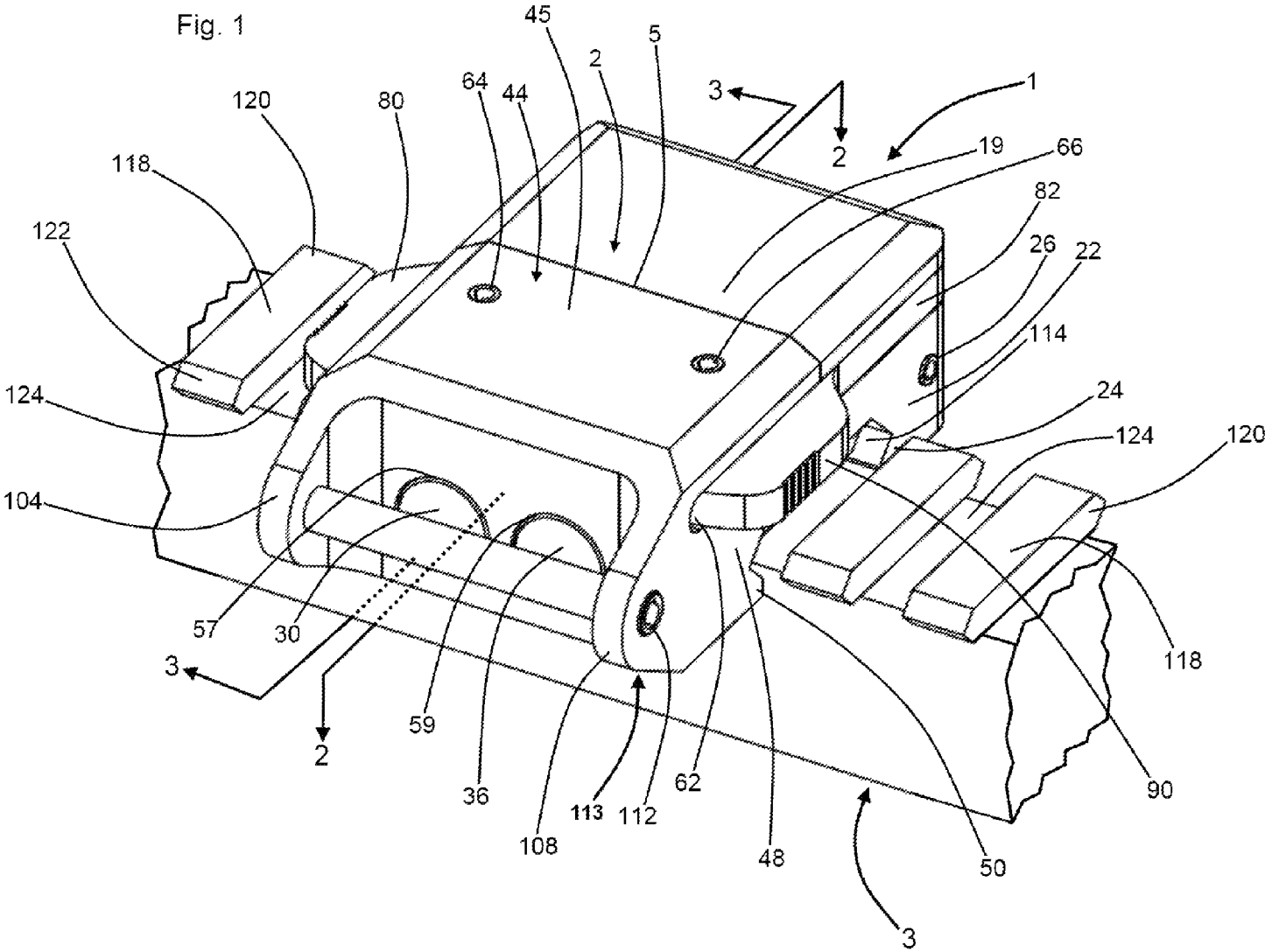
FIG. 1 is a perspective view of a preferred embodiment of the instant inventive firearm tactical rail mounting bracket, the view showing the mounting bracket attached to a section of a firearm's tactical rail.
Figure 5:
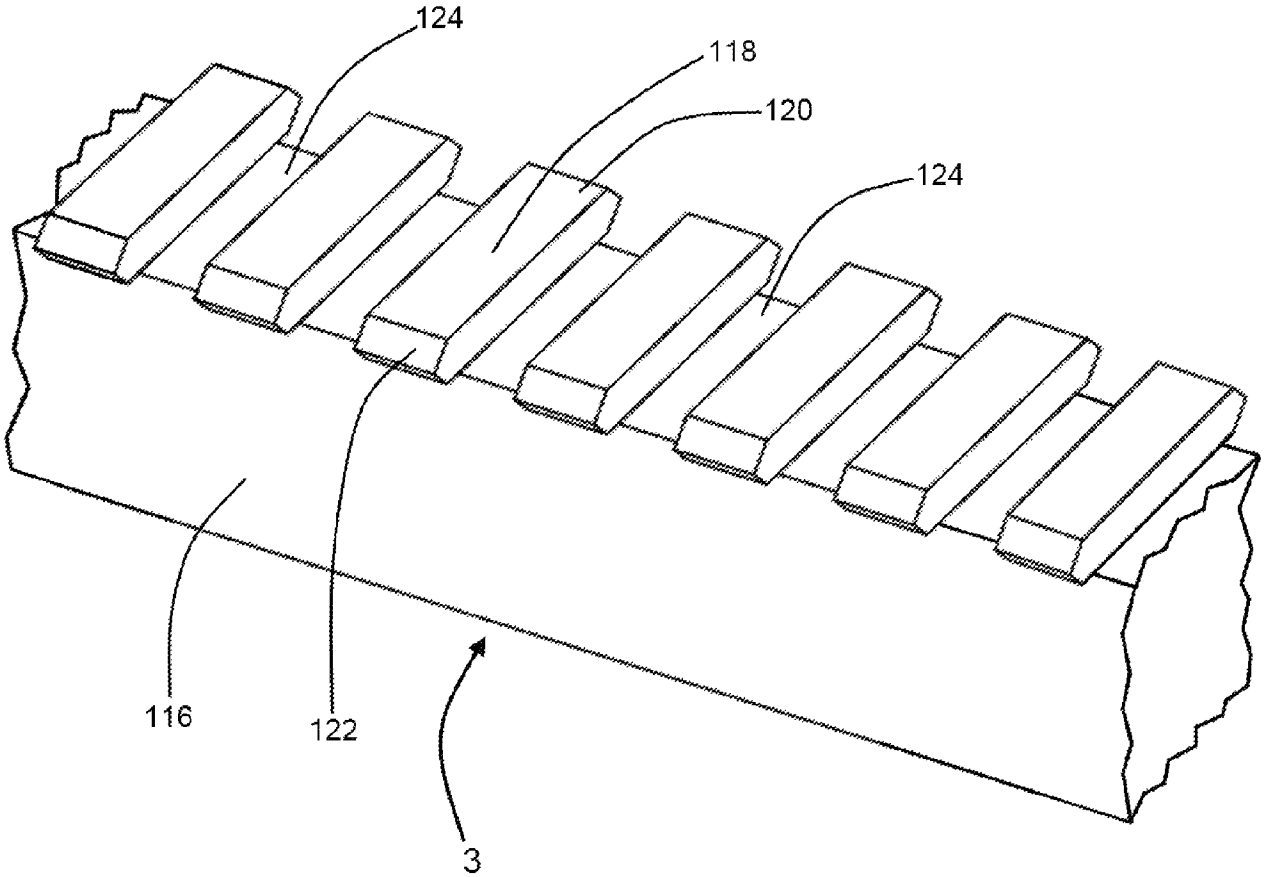
FIG. 5 redepicts the structure of FIG. 1, the view of FIG. 5 omitting the mounting bracket.
Figure 6:
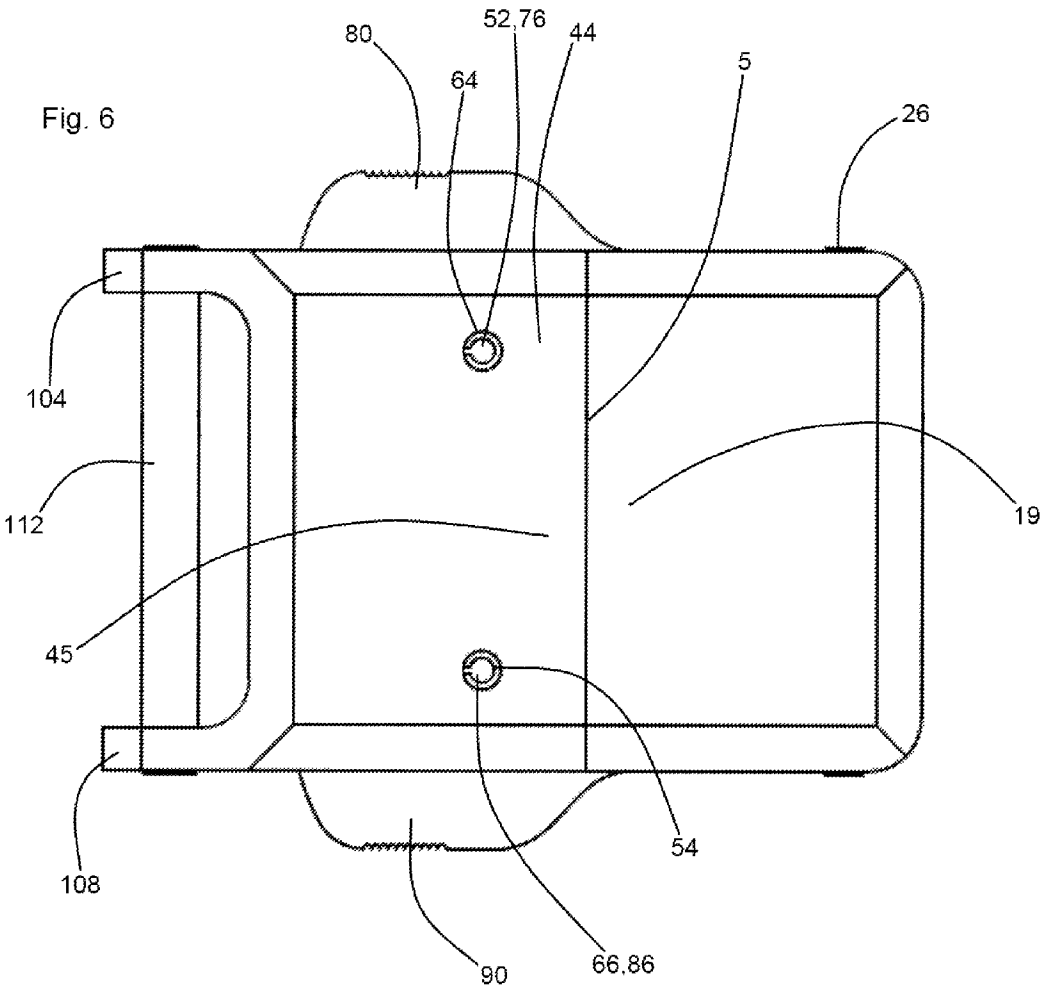
FIG. 6 is an upper plan view of the mounting bracket of FIG. 1.

Referring now to the drawings, and in particular to Drawing FIG. 1, a preferred embodiment of the instant inventive mounting bracket is referred to generally by Reference Arrow 1. Referring further simultaneously to FIG. 5, the mounting bracket 1 is preferably specially adapted for quick attachments to and quick releases from a firearm's tactical rail, a longitudinally extending section of which is referred to generally by Reference Arrow 3. Such tactical rail 3 is commonly alternatively referred to as a Picatinny rail, as a U.S. MIL-STD-1913 rail, or as a Nato Standard Agreement (STANAG) 2324 rail. The tactical rail 3 typically has a longitudinally extending series of "T" segments 118, each "T" segment 118 having lateral and oppositely lateral arms 122 and 120, such segments 118 defining a longitudinally extending series of voids 124. A longitudinally extending base 116 is fixedly attached to and extends inwardly from the "T" segments 118, such base 116 forming the column portion of the "T" configuration.

Figure 4:
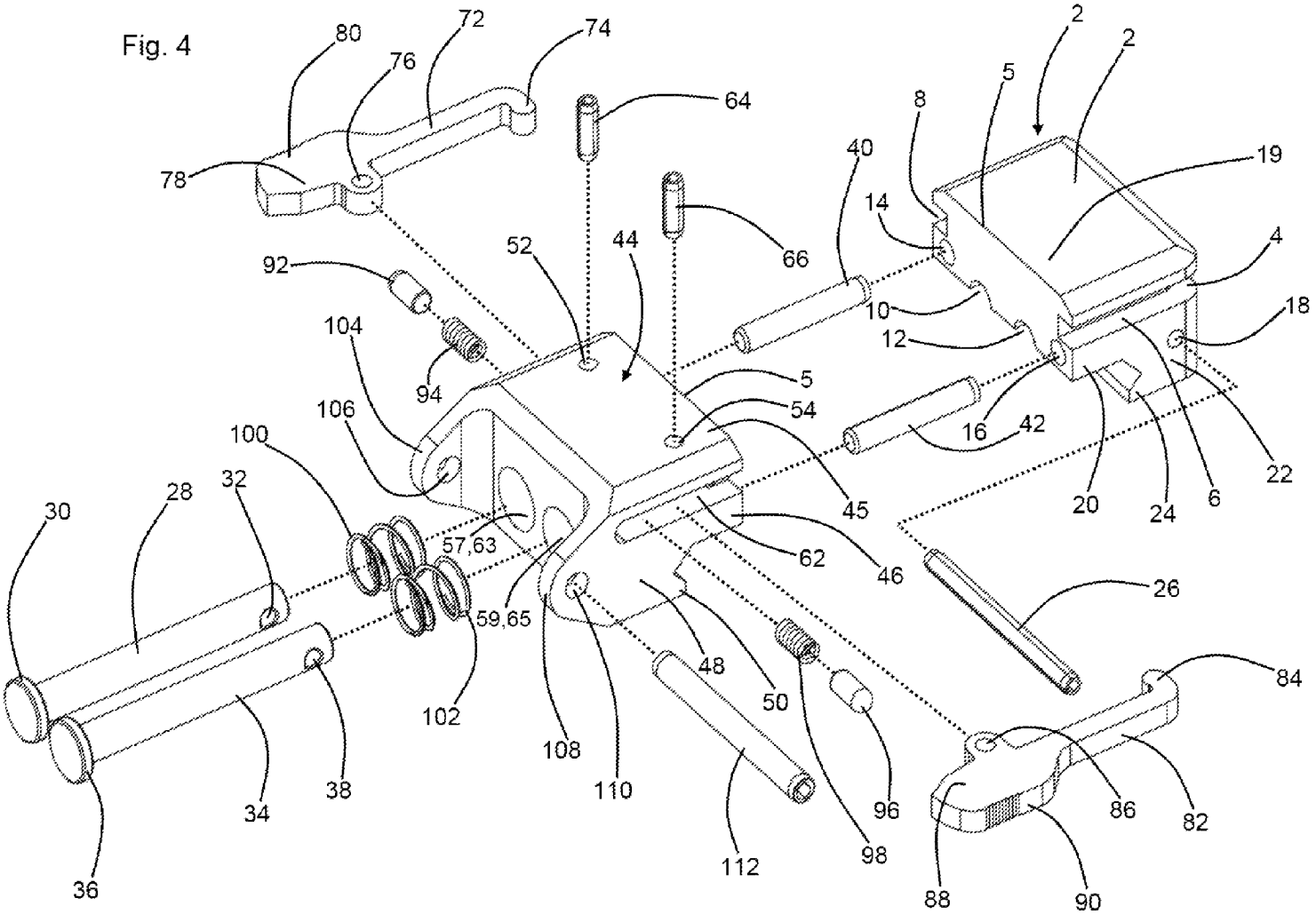
FIG. 4 is an exploded components view of the instant inventive mounting bracket.
Figure 7:
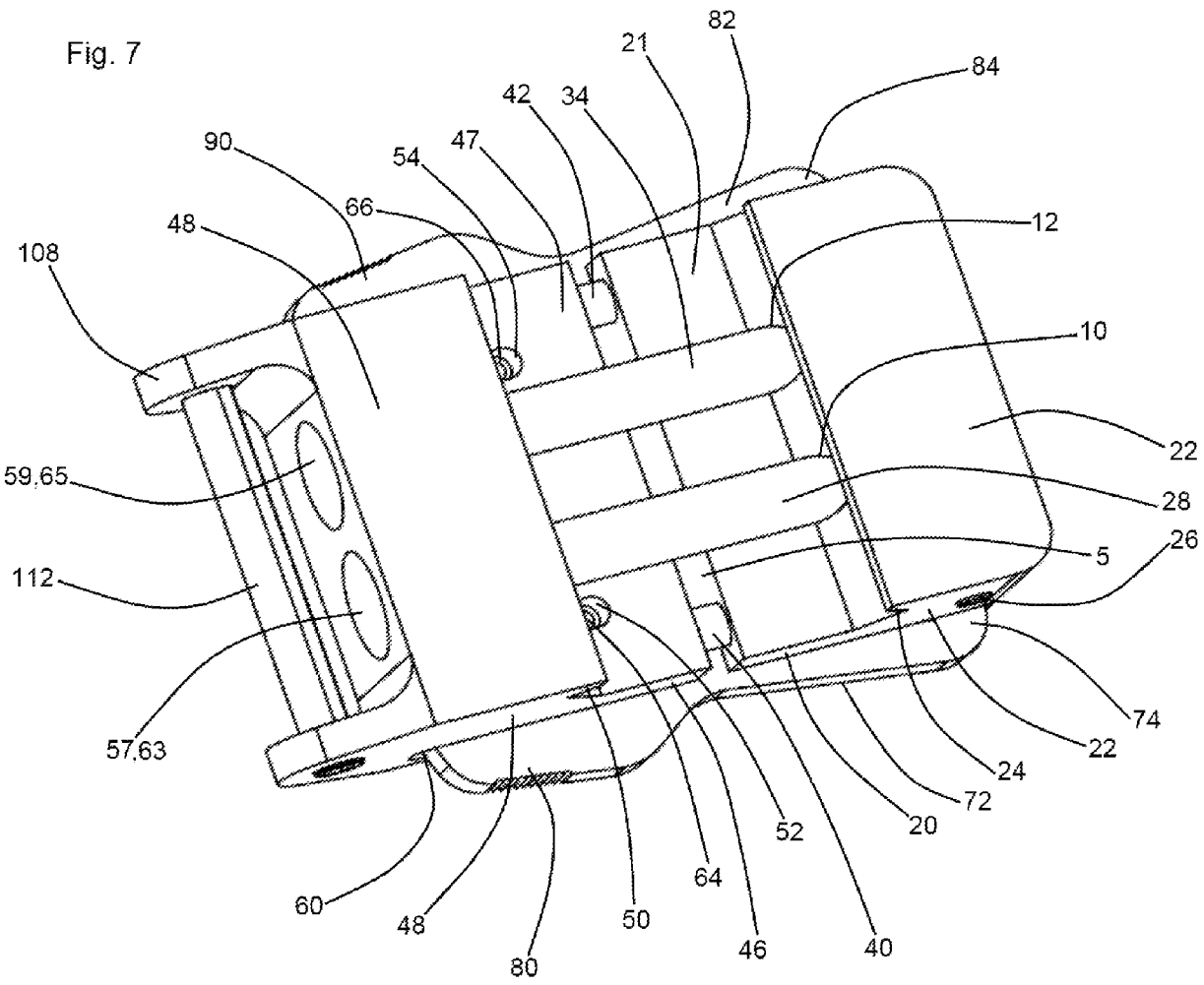
FIG. 7 is a lower perspective view of the mounting bracket of FIG. 1.
Figure 8:
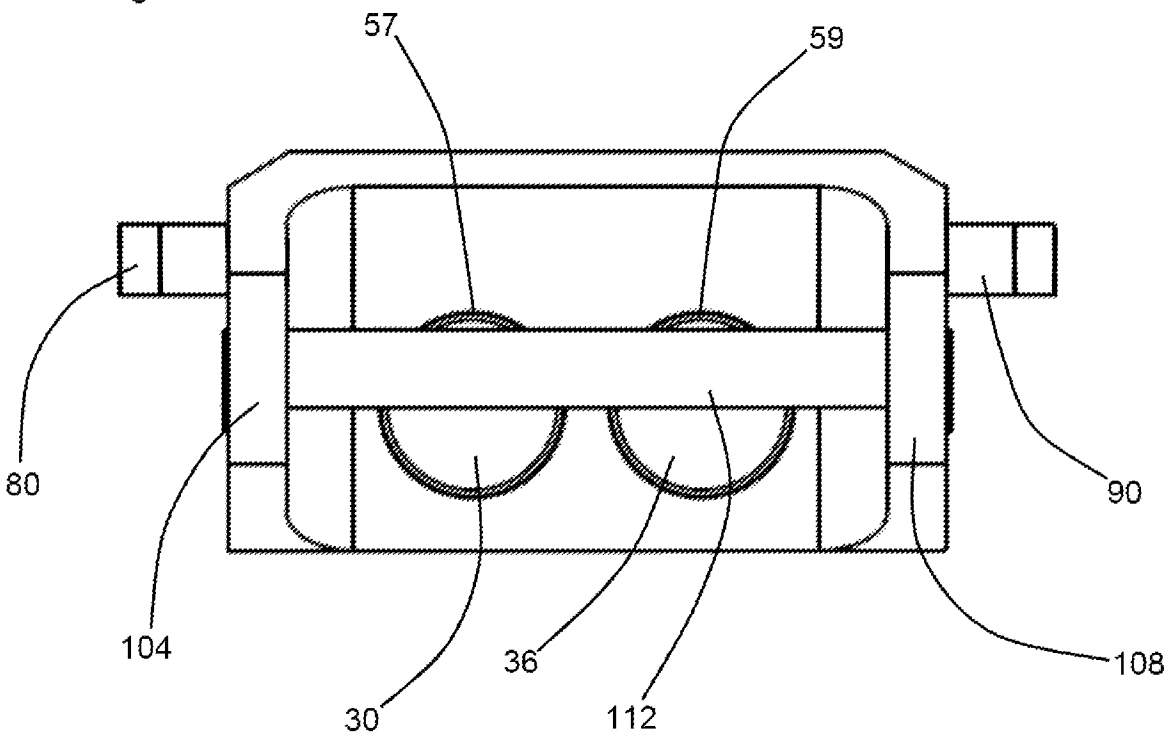
FIG. 8 is a lateral plan view of the mounting bracket of FIG. 1.

Referring simultaneously to FIGS. 1 and 4, the instant inventive mounting bracket 1 preferably forms and defines a "C" member, such member having a laterally extending web portion 46,20. Referring further simultaneously to FIG. 7, the web 46,20 has an inner face 47,21, and the web has an outer face 45,19. According to the perspective of Drawing FIG. 4, lateral and oppositely lateral ends of the web 46,20 are respectively to the left and to the right, and the longitudinal and oppositely longitudinal ends of the web 46,20 respectively face away from the viewer and face the viewer.

Figure 3:
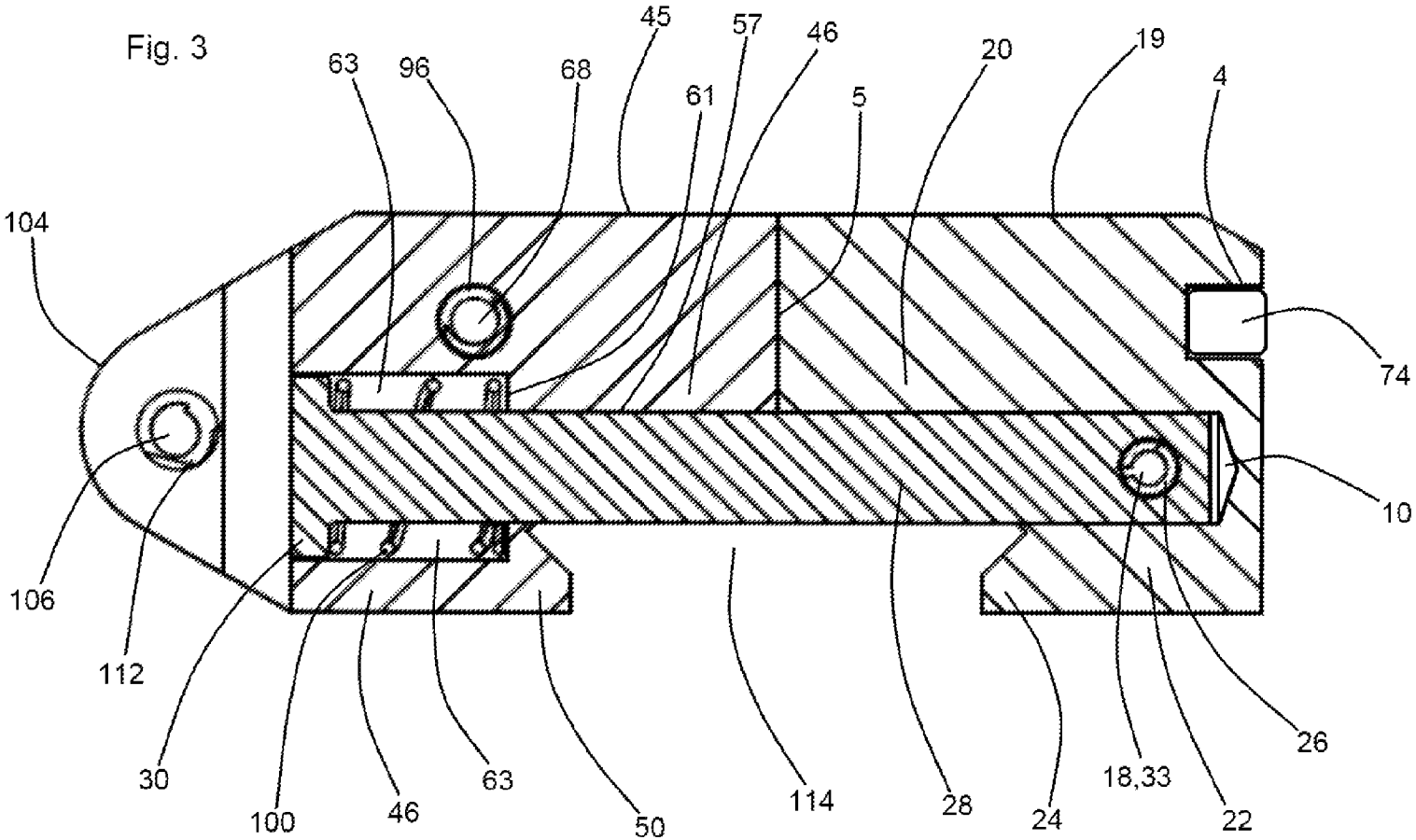
FIG. 3 is an alternative sectional view, also as indicated in FIG. 1.

Referring simultaneously to FIGS. 1, 4, and 7, the "C" member component of the mounting bracket 1 preferably further comprises and lateral and oppositely lateral hooks 48 and 22, such hooks preferably inwardly cantilevering from the lateral and oppositely lateral ends of the web 46 and 20 to present laterally inturned distal ends 50 and 24. Referring further to FIG. 3, the inner surfaces of such inturned distal ends 50 and 24 are preferably closely fitted to the distal end profiles of the lateral and oppositely lateral arms 122 and 120 of the tactical rail's "T" segments 118.

Referring simultaneously to FIGS. 1, 3, and 4, the "C" member preferably further comprises a longitudinal seam 5, such seam 5 advantageously dividing the "C" member into lateral and oppositely lateral halves which are respectively denoted by reference arrows 44 and 2.

Referring simultaneously to FIGS. 1, 3, 4, and 7 the instant inventive mounting bracket 1 preferably further comprises extending and retracting means which are connected operatively to the "C" member's lateral and oppositely lateral halves 44 and 2. In the depicted embodiment, the extending and retracting means comprise at least a first channel and slide bar combination, channel 10,57 representing such at least first channel, and a bar 28 representing such at least first slide bar. In the preferred embodiment, the extending and retracting means preferably further comprise a plurality of second slide bar and slide channel combinations 59,12,34, and 16,42, and 14,40. In the preferred embodiment, ends of slide channels 14 and 16 which reside at the laterally inward ends of web 46,20 near the seam 5 reside completely within web 46,20, while corresponding laterally inward ends of channels 57,10 and 59,12 semi-circumferentially reside within web 46,20. Such channels 57,10, and 59,12, for purposes further explained below, open inwardly toward "C" space 114 at the inner face 47,21 of the web 46,20. Such preferred configuration of the mounting bracket's extending and retracting means advantageously allows the "C" member's lateral and oppositely lateral halves 44 and 2 to slidably move between an opened first position, as depicted in 7, 10, and 11, and a retracted closed second position as depicted in FIGS. 1, 2, 3, 6, and 9.

Referring to FIG. 1, the instant inventive mounting bracket 1 preferably further comprises biasing means which are connected operatively to the mounting bracket for normally moving the "C" member's halves 44 and 2 toward their closed second positions. In a preferred embodiment, the biasing means comprise at least a first, and preferably a plurality of elastic member's. The elastic members preferably comprise, referring further simultaneously to FIGS. 3 and 4, helical compression springs 100 and 102. The lateral ends of the slide bar receiving channels 57,10 and 59,12 are preferably expanded to form interior annular spaces 63 and 65. Each of the annular spaces 63 and 65 includes an annular coffer or spring biasing land, the annular coffer at the oppositely lateral end of annulus 63 being specifically shown in FIG. 3. Such annular coffers 61 in combination with enlarged lateral end heads 30 and 36 of slide bars 28 and 34 effectively close the lateral and oppositely ends of the annuluses 63 and 65. Springs 100 and 102 which are captured within annuluses 63 and 65 effectively bias between the slide bar heads 30 and 36 and the "C" member's lateral half 44 for normally drawing the slide bars 28 and 34 laterally.

Referring to FIG. 4, the extending and retracting means preferably further comprise a pin 26 and alignable eyes or channels 18,32,38 combination, such combination allowing pin 26, upon longitudinal extension through eye 18 within the oppositely lateral "C" member half 2 and simultaneously through eyes 32 and 38 within the foot ends of slide bars 28 and 34, to rigidly attach and mount such slide bar foot ends upon "C" member half 2. In such configuration, normal expansion of springs 100 and 102 normally draws "C" member halves 2 and 44 toward each other to assume their closed second positions.

Figure 2:
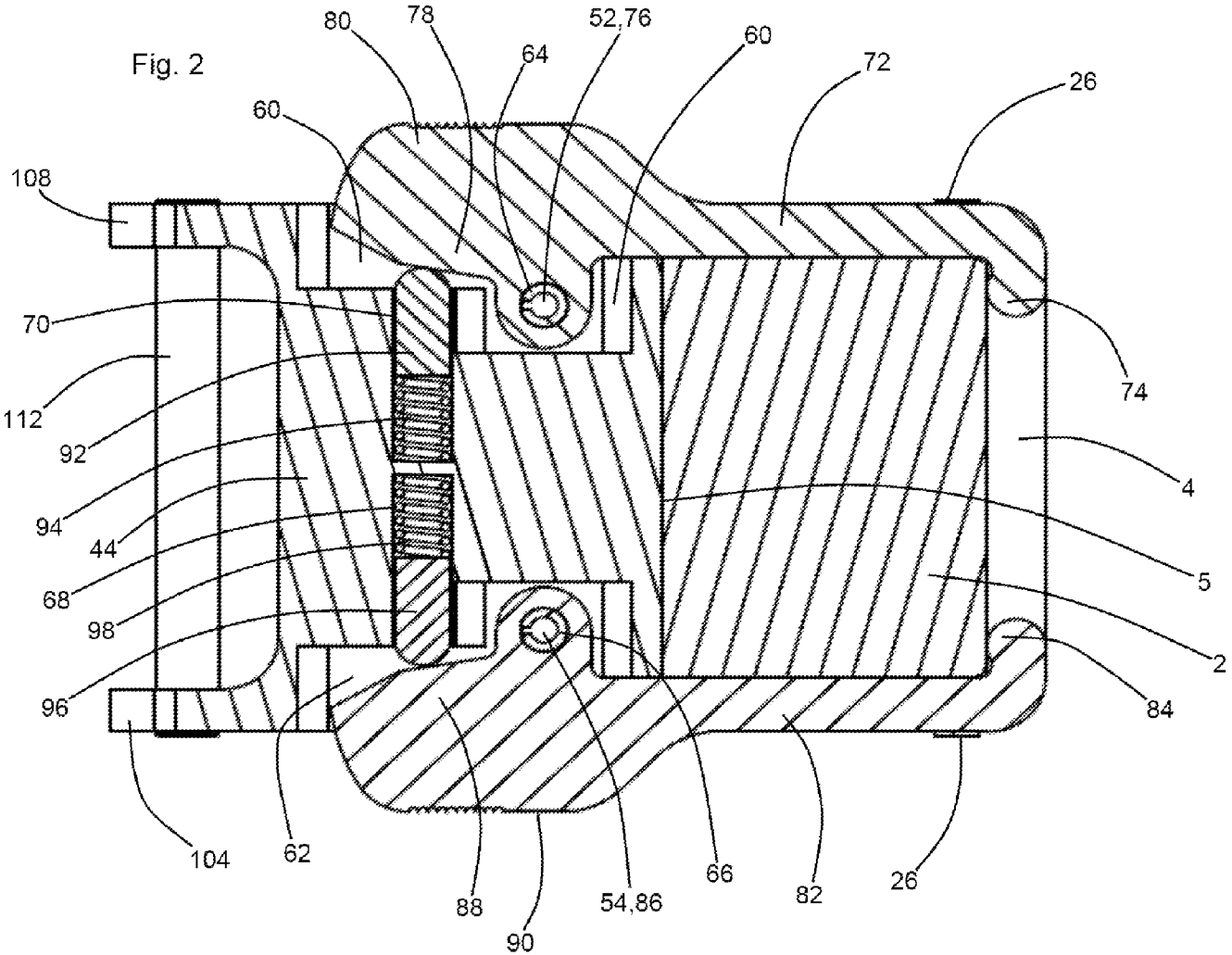
FIG. 2 is a sectional view as indicated in FIG. 1.

Referring simultaneously to FIGS. 1 and 2, further structural components of the instant inventive mounting bracket comprise latching means which are operatively connectable to the "C" member's lateral and oppositely lateral halves 44 and 2. In their preferred embodiments, the latching means are adapted for, upon movements of said halves 44 and 2 to their retracted second positions as depicted in FIG. 1, resisting any opening movement toward their first positions. The latching means are preferably further adapted for alternatively and selectively releasing said halves 44 and 2 for lateral movement away from each other toward their first rail releasing and receiving positions.

Referring simultaneously to FIGS. 1, 2, and 4, the latching means preferably comprise longitudinal and oppositely longitudinal pawls 82 and 72, such pawls respectively having hook ends configured as longitudinally inturned feet 84 and 74. The base ends of pawls 82 and 72 are preferably configured to present pivot pin receiving eyes 86 and 76.

Referring simultaneously to FIGS. 2 and 4, longitudinally opening and oppositely longitudinally opening latch channels 60,8, and 62,6, are preferably presented at the longitudinal and oppositely longitudinal ends of the "C" member's halves 44 and 2, such channels 60,8, and 62,6, preferably being closely fitted for respectively receiving pawls 72 and 82. Upon such channel's receipts of pawls 72 and 82, pivot pins 64 and 66 may be extended inwardly through pivot pin receiving channels 52 and 54 within lateral "C" member half 44, and thence through pivot pin receiving eyes 76 and 86 at the respective base ends of pawls 72 and 82. Such nesting receipts and pivotal attachments of the pawls 72 and 82 allow, referring further simultaneously to FIGS. 1 and 9, pawls 72 and 82 to move between engaged and disengaged positions, the pawl positions of FIG. 2 representing latching engagements wherein feet 74 and 84 securely hold "C" member halves 44 and 2 together and in abutment at seam 5. Upon counter-clockwise and clockwise pivoting movements of pawls 72 and 82 about pivot pins 64 and 66, feet 74 and 84 disengage from "C" member half 2, such disengagements allowing "C" member halves 2 and 44 to slidably move away from each other for tactical rail receipt or disengagement. The oppositely lateral end of "C" member half 2 preferably forms a foot receiving and shrouding channel 4, such channel preventing outside or foreign objects (not depicted within views) from contacting or snagging against feet 84 and 74, the channel 4 preventing unintentional and undesired disengagements of such feet.

Referring to FIG. 2, latch biasing means are preferably provided for normally moving pawls 82 and 72 toward their "C" member half engaging and latching positions, as depicted. In a preferred embodiment, the latch biasing means comprise a pair of lever arms 88 and 78, such arms preferably being respectively fixedly attached to and oppositely extending from pawls 82 and 72. Spring and plunger combinations 98,96, and 94,92 are preferably received within spring wells 68 and 70, such springs 98 and 94 normally respectively driving the oppositely longitudinal end of plunger 68 against lever arm 88, and driving the oppositely longitudinal end of plunger 92 against lever arm 78. Such biasing actions of springs 98 and 94 work in unison to normally pivot pawls 82 and 72 counter-clockwise and clockwise toward their depicted "C" member half engaging positions.

Figure 9:
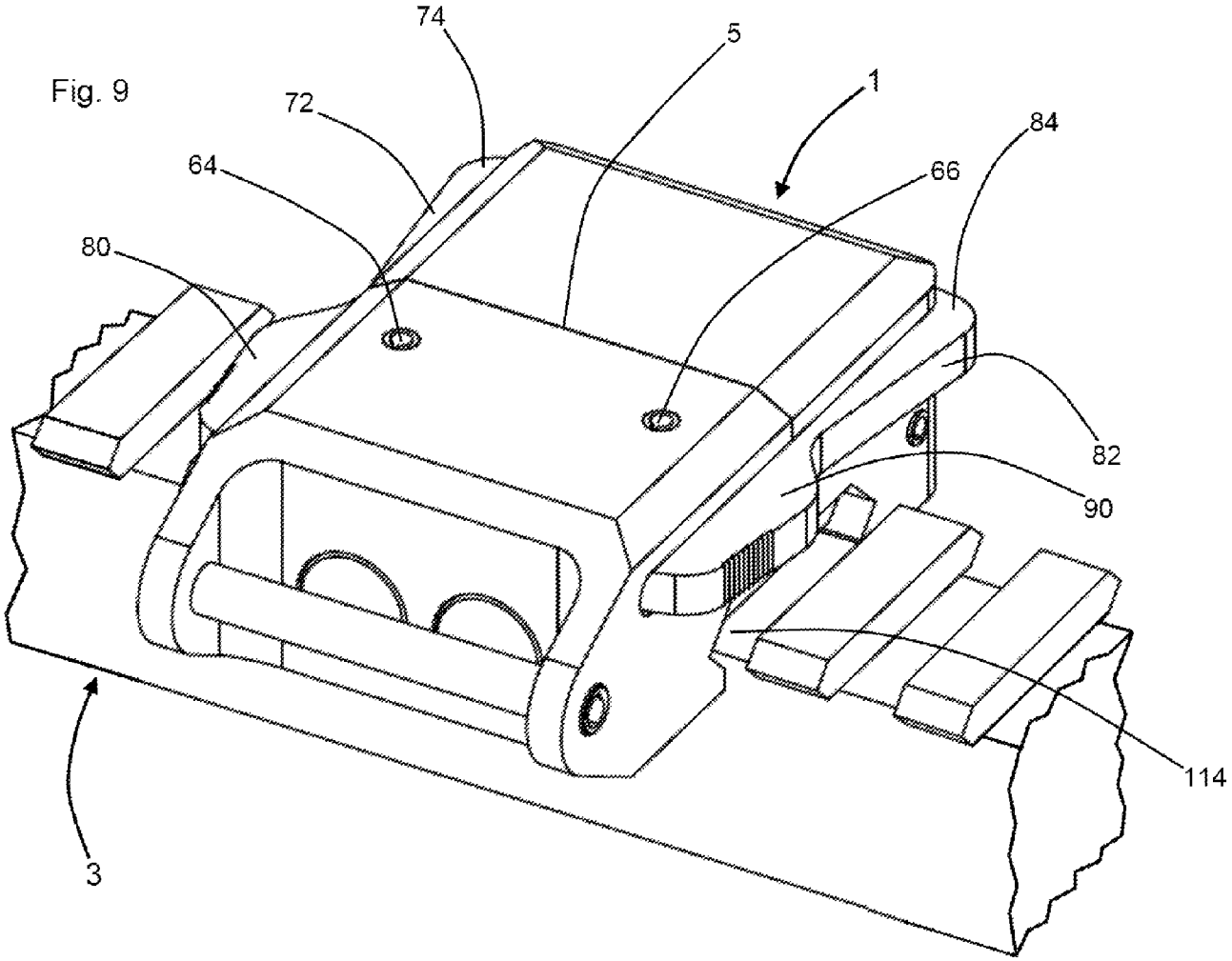
FIG. 9 redepicts FIG. 1, the view of FIG. 9 alternatively showing finger pressure squeeze flanges longitudinally and oppositely longitudinally depressed and showing latch pawls pivoted to their disengaged positions.

Referring simultaneously to FIGS. 1 and 2, squeeze flanges 80 and 90 preferably respectively extend longitudinally and oppositely longitudinally from lever arms 78 and 88, such flanges respectively extending longitudinally and oppositely longitudinally from channels 60 and 62 for exposure to compressive pressure. The incorporation of such squeeze flanges 80 and 90 advantageously allows an operator of the inventive mounting bracket 1 to depress such flanges 80 and 90 toward each other between index finger and thumb, such pressure advantageously pivoting the pawls 72 and 82 from their engaged positions as depicted in FIG. 2 to their disengaged positions, as depicted in FIG. 9. Upon release of such pressure (and upon movement of "C" member halves 44 and 2 to their normal retracted second positions), the latch biasing means 94,98,92,96,68,70 normally returns the pawls 72 and 82 to their "C" member half engaging positions.

Referring to FIG. 7, it may be seen that the inner peripheries of the bodies or mid-portions of slide bars 34 and 28 inwardly extend into and are exposed within the "C" space 114 which is defined between the "C" member's arms 48 and 22 and hooks 50 and 24. Referring further to FIG. 1, upon mounting of the bracket 1 upon the tactical rail 3, as depicted, the inner face 21,47 of the "C" member's web 20,26 preferably rests against and directly abuts upper surfaces of a plurality of the "T" segments 118. Such abutting contact of faces 21,47 against faces 118 is permitted only by virtue of inward extensions of the exposed inner peripheries of slide bars 28,34 into a successive pair of voids 124 formed between successive "T" segments 118. Upon such inward slide bar extensions, the inner peripheries of slide bars 28 and 34 preferably straddle a single "T" segment 118. Such peripheries are preferably longitudinally and oppositely longitudinally bounded by the two "T" ridges which are adjacent such straddled "T" ridge. The combination of such "T" ridge defined structural boundaries and inward extensions of slide bars effectively functions as at least first and second slide stops which, upon mounting of the bracket 1 as depicted in FIG. 1, beneficially resist any longitudinal or oppositely longitudinal movement of the bracket 1 with respect to the tactical rail 3. Accordingly, the slide bars 28 and 34 advantageously function both as core components of the invention's extending and retracting means, and as means for stopping any longitudinal movement of the mounting bracket 1 with respect to tactical rail 3.

Referring to all figures, in use of the inventive mounting bracket 1, the mounting bracket 1 may be preliminarily installed upon tactical rail 3, as depicted. Upon such mounting, outward movement of the bracket 1 with respect to rail 3 is resisted by engagements of hook ends 50 and 24 with "T" segment ends 122 and 120. Inward movement of the bracket 1 with respect to rail 3 is mechanically blocked by abutting contacts of web inner faces 21 and 47 with outer faces of "T" segments 118. Lateral and oppositely lateral movements of the bracket 1 with respect to the tactical rail 3 are blocked by engagements of arms 22 and 48 against "T" segments 118. Finally, longitudinal and oppositely longitudinal movements of the bracket 1 with respect to the tactical rail 3 are blocked via engagements of the inner peripheries of slide bars 28 and 34 with voids 124. Accordingly, the mounting bracket engagement depicted in FIG. 1 provides for universally directed resistance to movement of the bracket 1 with respect to the tactical rail 3. So long as the "C" member halves 2 and 44 are held in the second position depicted in FIG. 1 by latching engagements of pawls 82 and 72 and by the "C" member closing biasing action of springs 100 and 102, the mounting bracket 1 advantageously remains immovable with respect to tactical rail 3.

Figure 10:
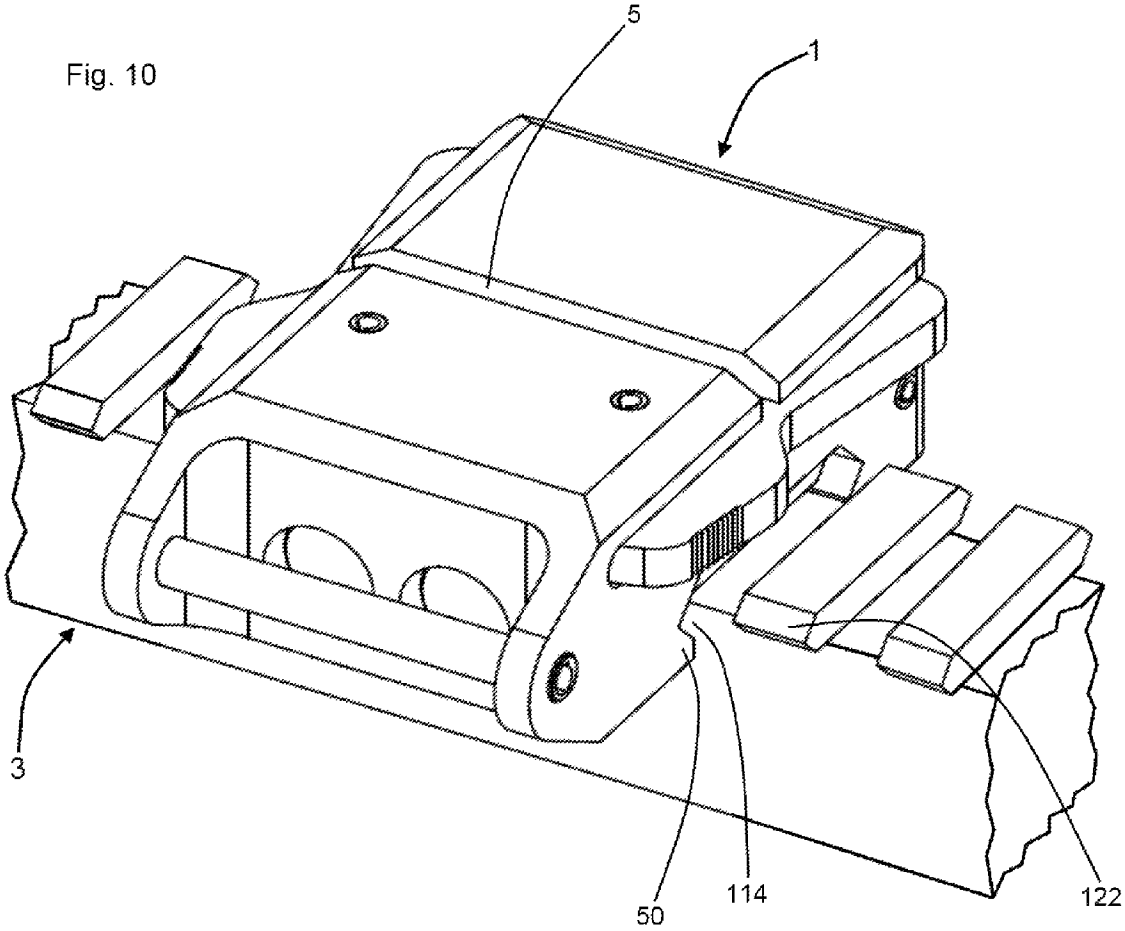
FIG. 10 redepicts FIG. 9, the view of FIG. 10 showing bracket halves laterally moved to first or opened positions with respect to each other.
Figure 11:
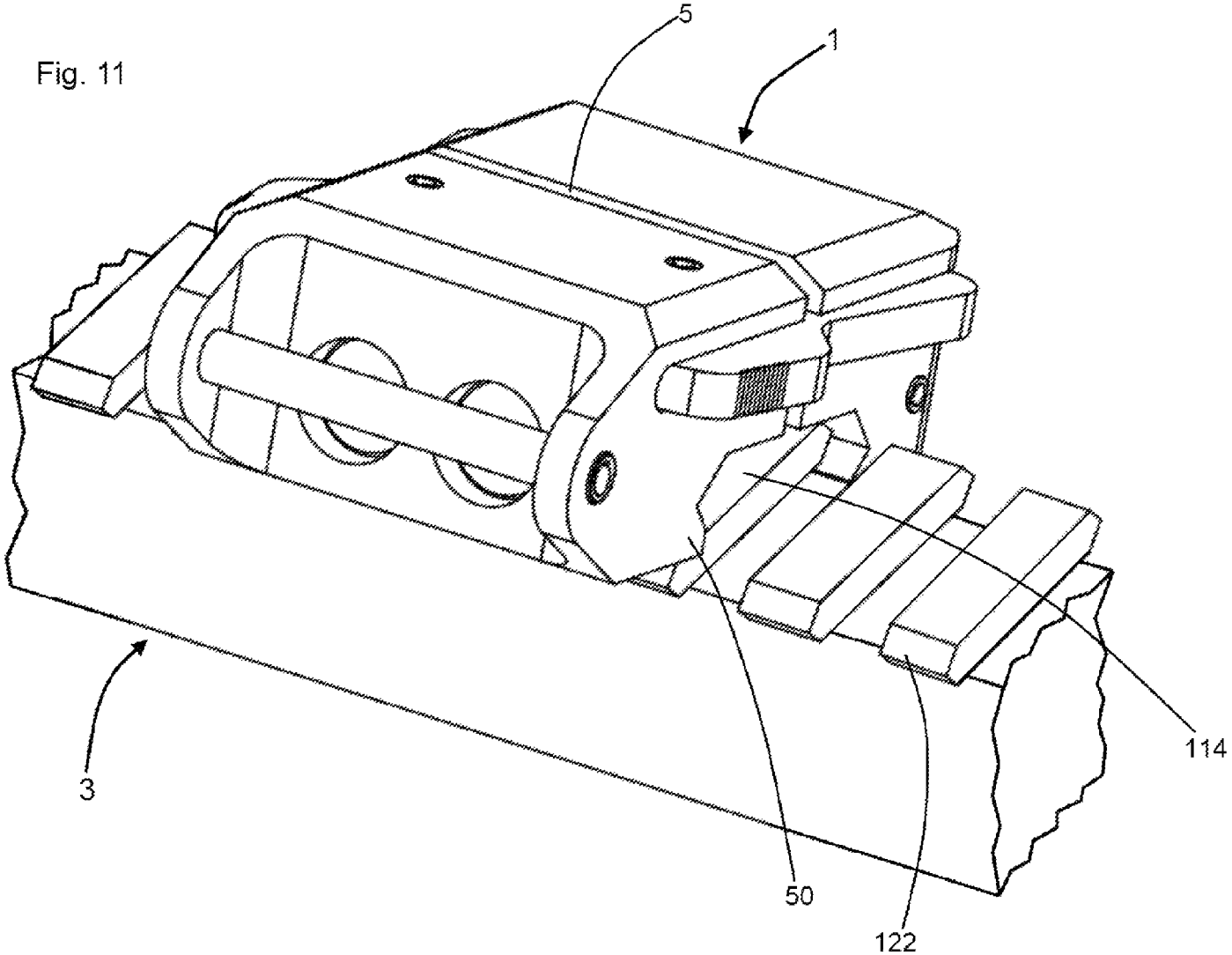
FIG. 11 redepicts FIG. 10, the view of FIG. 11 showing the inventive mounting bracket at a position either immediately preceding an attachment or immediately following a detachment.

Upon applying compressive finger pressure to squeeze flanges 90 and 80, feet 84 and 74 of pawls 82 and 72, pivot to disengage from the "C" member's oppositely lateral half 2. During and as a part of application of such finger pressure, the operator may laterally pull against squeeze flanges 80 and 90, moving lateral "C" member half 44 against springs 100 and 102 from the position depicted in FIG. 1 to the position depicted in FIG. 10. Upon application of such pulling force, the "C" member's lateral hook end 50 advantageously clears the lateral "T" segment arms 122. Thereafter, referring further to FIG. 11, the mounting bracket 1 may be outwardly pivoted or tilted from the position depicted in FIG. 10 to the position depicted in FIG. 11, effectively disengaging the mounting bracket 1 from the tactical rail 3. A reverse of the steps described above effectively installs the mounting bracket 1 upon the tactical rail 3.

Figure 12:
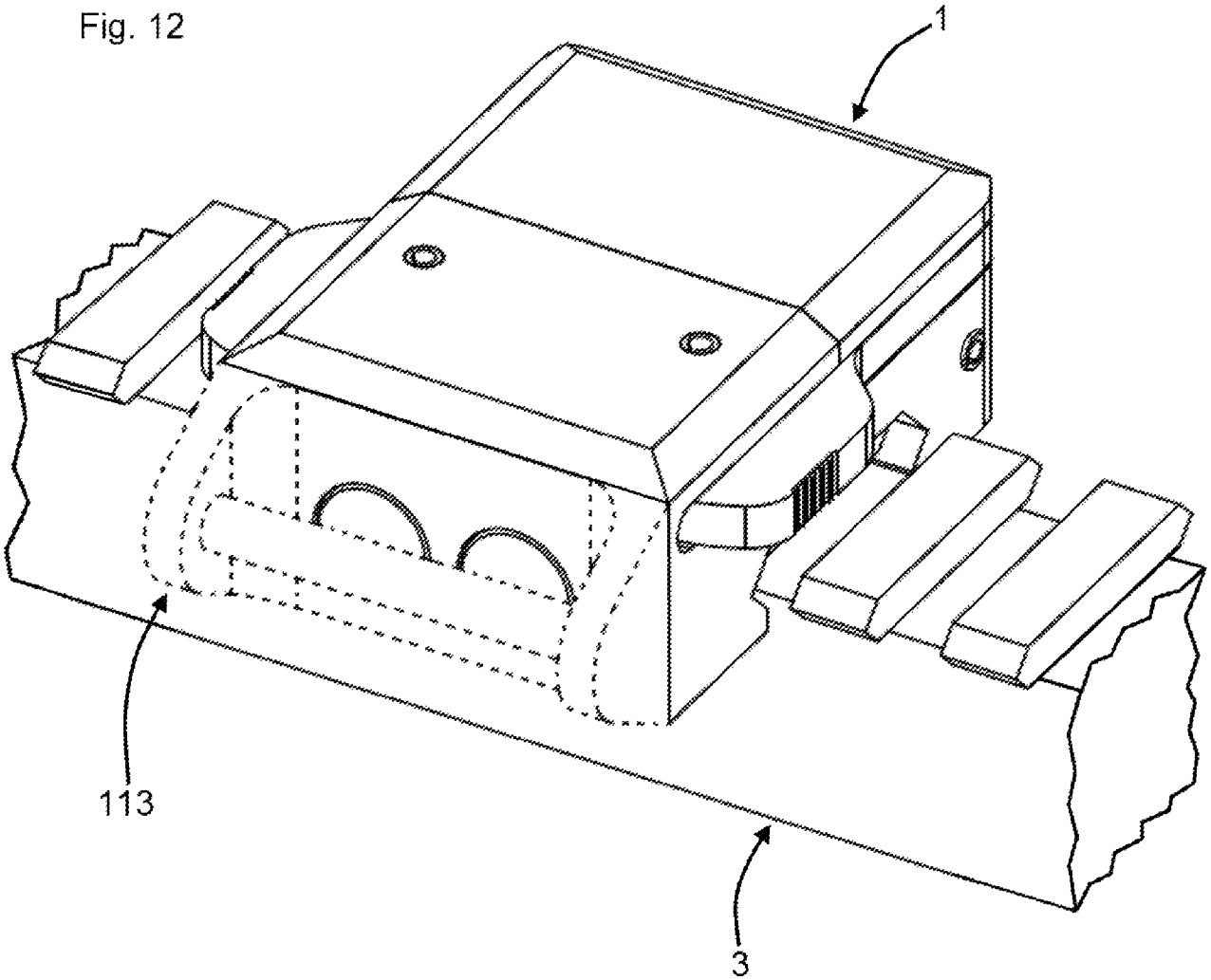
FIG. 12 redepicts FIG. 1, the view of FIG. 12 representationally showing a gun sling component in dashed lines.

Referring simultaneously to FIGS. 1 and 12, a gun sling loop which is referred to generally by Reference Arrow 113 is representationally shown (via the dashed lines of FIG. 12) fixedly attached to or formed wholly with the lateral wall of the "C" member's lateral half 44, such gun sling loop 113 comprising clevis ears 104 and 108, such clevis ears having longitudinally opening eyes 106 and 110, and such clevis ears and eyes forming a sling loop by supporting a cross pin 112.

Figure 13:
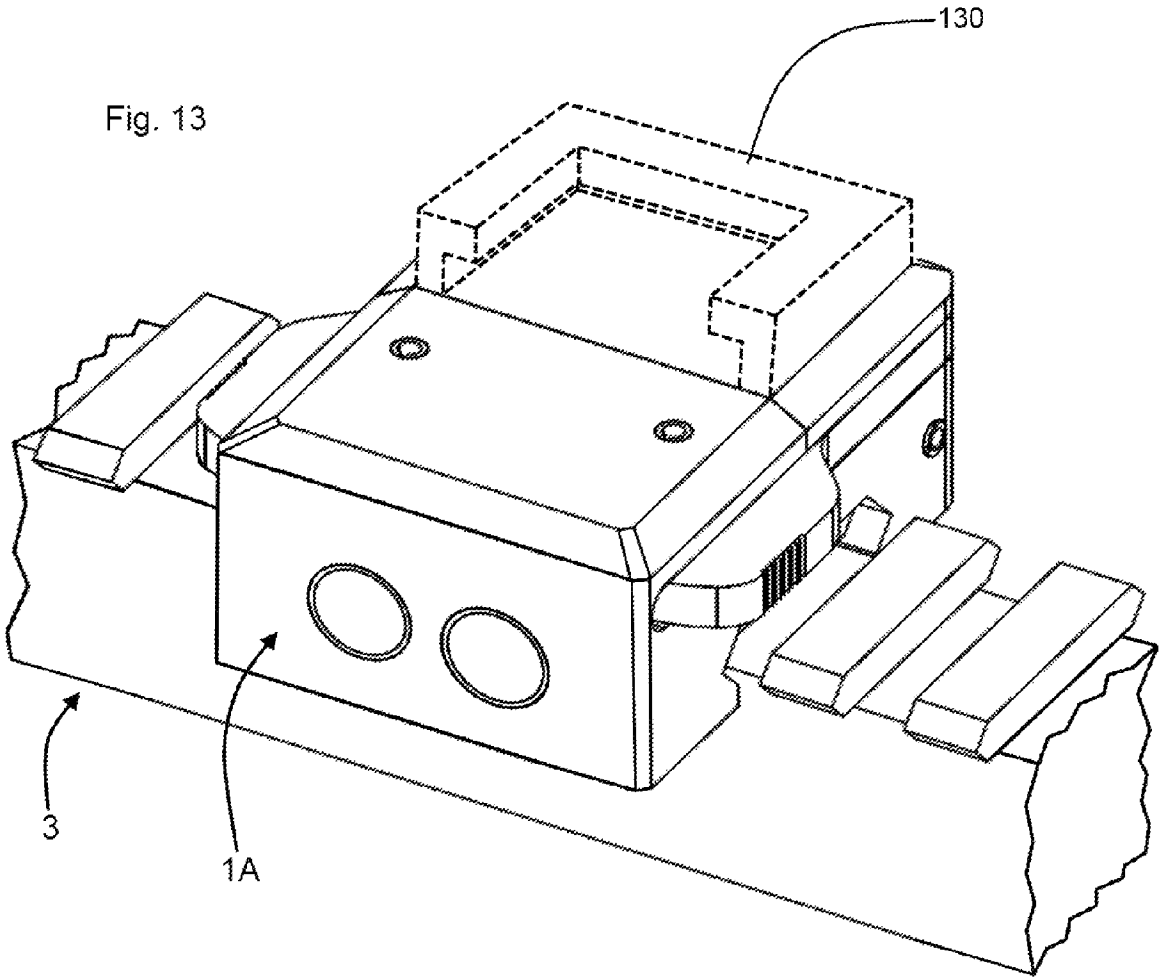
FIG. 13 redepicts FIG. 12, the view of FIG. 13 alternatively showing in dashed lines, an alternatively configured auxiliary firearm component mounting bracket.

Referring in particular to FIG. 13, all reference numerals having the suffix "A" are configured substantially identically with similarly numbered structures appearing in other drawings. In FIG. 13, the gun sling loop 113 of FIGS. 1 and 12 is deleted, and an auxiliary firearm component attachment bracket 130 is representationally drawn in dashed lines. Such bracket 130 may be utilized for auxiliary gun mounting of components such as optical sights, telescopic sights, infra-red night vision sights, laser target illuminators, flashlights, spent shell catching receptacles, and the like.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A mounting bracket for attachment to a firearm's longitudinally extending tactical rail, said rail presenting an alternating series of "T" segments and voids, each "T" segment having a pair of laterally extending arms, said rail having a base extending inwardly from the "T" segments, the mounting bracket comprising:

(a) a "C" member having a web having outer and inner faces, the web further having an opposing pair of lateral ends, and an opposing pair of longitudinal ends, said end pairs being oriented substantially orthogonally with respect to each other; the "C" member further having a pair of hooks, each hook having a distal end, said each hook being fixedly attached to one of the lateral ends of the web, and said each hook cantilevering inwardly, the "C" member further having a seam segmenting the "C" member into a pair of lateral halves;

(b) means for extending and retracting, said means being connected operatively to the lateral halves, said means being adapted for facilitating movements of the lateral halves between first and second positions wherein said halves, upon movements to their first positions, and displaced laterally from each other for "T" segment receipts and releases, and wherein said halves, upon a "T" segment receipt and upon movements toward their second positions, may capture the "T" segment between the pair of hooks; and (c) means for latching, said means being connected operatively to the pair of lateral halves, said means being adapted for, upon the movements of said halves to their second positions, alternatively resisting and permitting the movements of said halves toward their first positions, wherein the means for extending and retracting comprise an at least a first slide bar and at least first slide channel combination, the at least first slide channel extending through at least one of the lateral halves.

2. The mounting bracket of claim 1 wherein the at least first slide channel opens at the inner face of the web, and further comprising at least a first void engaging slide stop, said slide stop comprising an inward extension of the at least first slide bar from said inner face.

3. The mounting bracket of claim 2 wherein the means for extending and retracting further comprise a plurality of second slide bar and slide channel combinations, one of the second slide bars extending inwardly from the inner face of the web of the "C" member, said inward extension comprising a second void engaging slide stop.

4. Then mounting bracket of claim 3 wherein the first and second void engaging slide stops are positioned with respect to each other for longitudinally straddling at least a first tactical rail "T" segment.

5. The mounting bracket of claim 1 further comprising means for biasing the "C" member, said means operatively interconnecting the lateral halves of the "C" member, the means for biasing the "C" member being adapted for normally moving said lateral halves toward their second positions.

6. The mounting bracket of claim 5 wherein the means for biasing the "C" member comprise at least a first elastic member.

7. The mounting bracket of claim 6 wherein the at least first elastic member comprises a helical compression spring, said spring co-axially receiving the at least first slide bar.

8. The mounting bracket of claim 7 wherein the at least first slide bar has an enlarged head, wherein the at least first slide channel is annularly coffered, and wherein the means for biasing the "C" member further comprise at least a first annulus having a pair of lateral ends, the at least first annulus being radially inwardly bounded by the at least first slide bar, one of the lateral ends of the at least first annulus being closed by the annular coffer, the other lateral end of the at least first annulus being closed by the enlarged head of the at least first slide bar, and the co-axial receipt by the helical compression spring of the at least first slide bar positioning said spring within the at least first annulus.

9. The mounting bracket of claim 1 wherein the means for latching comprise a pair of pawls, each pawl having a base end and a hook end, the base end of each pawl being attached to one of the lateral halves and the hook end of said each pawl being adapted for releasably engaging the other lateral half.

10. The mounting bracket of claim 9 wherein the base end attachments of the pair of pawls comprise pivot joints.

11. The mounting bracket of claim 10 further comprising means for latch biasing, said means being connected operatively to the pair of pawls, the means for latch biasing being adapted for, upon engagements of the hook ends of said pawls with said other lateral half, resisting disengagements of said hook ends.

12. The mounting bracket of claim 11 wherein the means for latch biasing comprise spring and lever arm combinations, wherein each lever arm extends from one of the pawls, and wherein each spring spans between the one of the lateral halves and one of the lever arms.

13. The mounting bracket of claim 11 wherein the means for latching further comprise longitudinally opening channels, each longitudinally opening channel being positioned at one of the longitudinal ends of the "C" member and being fitted for nestingly receiving the one of the pawls.

14. The mounting bracket of claim 13 further comprising a pair of squeeze flanges, each flange among the pair of squeeze flanges being fixedly attached to and extending longitudinally from one of the spring and lever arm combinations.

15. The mounting bracket of claim 9 wherein the hook ends of the pair of pawls comprise a pair of feet, each foot among the pair of feet extending toward the other foot among said pair.

16. The mounting bracket of claim 15 further comprising a laterally opening foot receiving channel.

17. The mounting bracket of claim 1, further comprising an auxiliary gun component attachment bracket fixedly attached to the "C" member.

18. The mounting bracket of claim 1 wherein the at least first slide bar has a head end and a foot end, and further comprising a pin and alignable eyes combination, the alignable eyes of said combination extending through the foot end of the at least first slide bar and further extending through one of the lateral halves, said pin, upon alignments of said eyes, being extendable therethrough for attaching the at least first slide bar to the one of the lateral halves.

19. The mounting bracket of claim 18 wherein the means for extending and retracting further comprise a second slide bar and slide channel combination, the slide bar of said combination having a head end and a foot end, the alignable eyes of the pin and alignable eyes combination further extending through said foot end, the pin of said combination being further extendable through said foot end for attaching the second slide bar to the one of the lateral halves.

* * * * *